US005660868A

United States Patent [19]

Yeager

[11] Patent Number: 5,660,868

[45] Date of Patent: Aug. 26, 1997

[54] STORAGE BAG WITH SOAKER PAD

[76] Inventor: James W. Yeager, 505 E. Cumberland Rd., Mobile, Ala. 36608

[21] Appl. No.: 632,320

[22] Filed: Apr. 15, 1996

Related U.S. Application Data

[63] Continuation of Ser. No. 276,882, Jul. 18, 1994, abandoned, which is a continuation of Ser. No. 909,106, Jul. 1, 1992, abandoned.

[51] Int. Cl.[6] ..... B65D 81/26

[52] U.S. Cl. ..... 426/124; 206/204; 426/112; 426/129

[58] Field of Search ..... 426/124, 129, 426/112; 206/204, 205

[56] References Cited

U.S. PATENT DOCUMENTS

| | | | |
|---|---|---|---|
| 2,300,041 | 10/1942 | Bradley | 426/124 |
| 2,518,406 | 8/1950 | Weber | 426/129 |
| 2,537,196 | 1/1951 | Tanski | 312/31.2 |
| 2,545,710 | 3/1951 | Snyder | 206/204 |
| 3,026,209 | 3/1962 | Niblack et al. | 426/129 |
| 3,040,947 | 6/1962 | Wells et al. | 426/129 |
| 3,084,984 | 4/1963 | Adler | 206/204 |
| 3,156,402 | 11/1964 | Dupuis | 229/30 |
| 3,288,346 | 11/1966 | Peppler | 426/129 |
| 3,415,662 | 12/1968 | Koger et al. | 426/124 |
| 3,670,874 | 6/1972 | Brunner | 426/129 |
| 3,834,606 | 9/1974 | Andersson | 426/129 |
| 4,081,580 | 3/1978 | Kato | 426/129 |
| 4,136,203 | 1/1979 | Murphy et al. | 426/129 |
| 4,136,205 | 1/1979 | Quattlebaum | 426/129 |
| 4,267,960 | 5/1981 | Lind et al. | 426/129 |
| 4,275,811 | 6/1981 | Miller | 206/204 |
| 4,321,997 | 3/1982 | Miller | 206/204 |
| 4,382,507 | 5/1983 | Miller | 206/204 |
| 4,390,554 | 6/1983 | Levinson | 426/124 |
| 4,401,213 | 8/1983 | Lerner | 206/204 |
| 4,410,578 | 10/1983 | Miller | 428/117 |
| 4,619,361 | 10/1986 | Thomas | 206/204 |
| 4,629,064 | 12/1986 | Barner | 206/204 |
| 4,702,377 | 10/1987 | Grone | 426/129 |
| 4,735,308 | 4/1988 | Barner | 206/204 |
| 4,742,908 | 5/1988 | Thomas, Jr. et al. | 206/204 |
| 4,756,939 | 7/1988 | Goodwin | 428/74 |
| 4,815,590 | 3/1989 | Peppiatt | 206/204 |
| 4,861,632 | 8/1989 | Caggiano | 428/35.2 |
| 4,865,855 | 9/1989 | Hansen et al. | 426/129 |
| 4,935,282 | 6/1990 | Pawlowski et al. | 426/129 |
| 4,940,621 | 7/1990 | Rhodes et al. | 426/129 |
| 4,949,897 | 8/1990 | Pawlak et al. | 426/129 |
| 4,984,907 | 1/1991 | Power | 206/204 |
| 5,055,332 | 10/1991 | Rhodes et al. | 428/74 |

FOREIGN PATENT DOCUMENTS

| | | | |
|---|---|---|---|
| 827504 | 11/1969 | Canada | 426/124 |
| 230522 | 1/1990 | Japan | 426/124 |
| 257582 | 2/1990 | Japan | 426/124 |
| 257583 | 2/1990 | Japan | 426/124 |
| 2282082 | 11/1990 | Japan | 426/124 |
| 3289470 | 12/1991 | Japan | 426/129 |
| 1131848 | 10/1968 | United Kingdom | 426/124 |
| 2003836 | 3/1979 | United Kingdom | 426/124 |

*Primary Examiner*—Steven Weinstein
*Attorney, Agent, or Firm*—David L. Ray

[57] ABSTRACT

A storage bag with soaker pad. The bag of the invention includes a bag having a front and rear panel of a plastic film, the front and rear panels being closed at one end to form a bottom of the bag, the bag being open at the opposite end for receipt of goods to be stored in the bag, a fluid absorbing pad located inside the bag, and an enclosure connected to the inside of the bag for containing the fluid absorbing pad.

19 Claims, 3 Drawing Sheets

STORAGE BAG WITH SOAKER PAD

This application is a continuation, of application Ser. No. 08/276,882 filed on Jul. 18, 1994 for STORAGE BAG WITH SOAKER PAD, now abandoned, which is a continuation of application Ser. No. 07/909,106 filed on Jul. 1, 1992 for STORAGE BAG WITH SOAKER PAD, now abandoned.

BACKGROUND OF THE INVENTION

1. Field of the Invention

The invention relates to storage bags. More particularly, the present invention relates to food storage bags having soaker pads therein for absorbing juices which flow from food contained in the bags.

2. Description of the Related Art

Food storage bags and soaker pads are known in the art. Exemplary of such bags and soaker pads are those disclosed in the following U.S. Patents:

U.S. Pat. No. 5,055,332 discloses an absorbent pad and method for constructing same for meat and poultry products and the like. The absorbent pad includes upper and lower plastic film layers, at least one of which is perforated, and an intermediate absorbent pad includes upper and lower plastic film layers, at least of which is perforated, and an intermediate absorbent layer includes a series of juxtaposed and overlapping absorbent material fibers with superabsorbent granules dispersed throughout the absorbent layer and supported by the absorbent material fibers of one or several types, even when the absorbent material fibers have liquid therein. The superabsorbent granules are fixed and held in place by structurally interacting absorbent material fibers and/or by attachment to one or more of the types of absorbent material fibers constituting the absorbent layer. The upper and lower layers are attached to one another at least partially along opposite marginal edge portions thereof to retain the absorbent layer between the upper and lower layers. The superabsorbent granular particles are homogeneously dispersed throughout the absorbent layer and supported in generally spaced relationship within the interstices of the absorbent material fibers, to enable suspension and retention of liquid by the superabsorbent granules and absorbent material fibers.

U.S. Pat. No. 4,861,632 discloses a laminated bag which is a packaging material from which package type containers are fabricated for storing or transporting a variety of products ranging from dry food-stuffs to electronic equipment where maintenance of a dry environment is a requirement, including an outer imperforate water impervious layer, a middle layer of absorbent material and an inner perforated moisture impervious layer.

U.S. Pat. No. 4,815,590 discloses a plastic bag with absorbent insert for packaging articles including fresh meats and the like which has an absorbent insert attached to the interior surface of the rear panel of the bag. The insert is generally rectangular and is attached to the rear panel along the side closest to the bag opening so that the insert cannot be dislodged when the bag is filled. The insert absorbs blood and other fluids in the meats to keep the package neat and clean and minimize the danger of leakage.

U.S. Pat. No. 4,756,939 discloses an absorbent pad for use in packaging food products which is adapted for placement in a package beneath a food product having a tendency to exude fluid. The pad includes a mat of fluid absorbent material having two oppositely facing substantially flat surfaces with side portions, and a cover, made from a liquid impermeable material enclosing the mat, having two oppositely facing substantially flat imperforate surfaces, corresponding with the oppositely facing surfaces of the mat, and side portions corresponding with the side portions of the mat. At least two of the side portions of the cover have a plurality of perforations along their extent to permit passage of the exuded material through the cover for absorption by the mat.

U.S. Pat. No. 4,742,908 discloses a bag with a soaker pad for packaging and displaying meat or poultry having a front and rear thermoplastic panel joined at a fold line at the bottom of the bag. An absorbent pad, having a non-stick layer, an absorbent layer and a securing device, is positioned at the bottom of the bag. The pad extends over both the front and rear panels and is secured to the panels. An opaque printing is provided on the panels and corresponds generally to the position of the pad.

U.S. Pat. No. 4,735,308 discloses a compound food storage bag which is an internally lined food storage bag useful in the storage of moisture-retentive foods such as fruits and vegetables. The storage bag includes a hand-closed water-impermeable outer bag containing an absorbent inner bag. The inner bag is made of water absorbent paper or paper-like material attached to the bottom and in small areas (i.e., spots) only part of the way up the interior of the outer bag, thereby enabling separate closure.

U.S. Pat. No. 4,629,064 discloses a compound food storage bag which is useful in the storage of moisture-retentive foods such as fruits and vegetables. The storage bag includes a hand-closed water impermeable outer bag containing an absorbent inner bag. The inner bag is made of water absorbent paper of paper-like material attached at the bottom and in small areas (i.e., spots) only part of the way up the interior of the outer bag, thereby enable separate closure.

U.S. Pat. No. 4,619,361 discloses a bag for displaying food having a front and rear thermoplastic panel joined at a fold line at the bottom of the bag. An absorbent pad, having two impervious non-stick layers sandwiching a non-woven absorbent layer, is positioned at the bottom of the bag. The pad extends over both the front and rear panels and is thermally welded to the panels. An opaque printing is provided on the panels and corresponds generally to the position of the pad.

U.S. Pat. No. 4,410,578 discloses a receptacle for moisture exuding food products including an absorbent pad for use in a receptacle intended to contain and display food products which tend to exude juices or liquids. The absorbent pad includes a mat of liquid absorbent material, and upper liquid impermeable plastic sheet overlying the absorbent mat, and a bottom plastic sheet underlying the absorbent mat, and a bottom plastic sheet underlying the absorbent mat. At least one of the sheets is perforated, and a spacer is disposed between the two sheets to maintain their separation under a compressive load, and such that the ability of the pad to absorb liquids is unimpaired when the pad is subjected to a compressive load resulting from the food product resting thereon or the like. Preferably only the bottom sheet is perforated, and When a food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life.

U.S. Pat. No. 4,401,213 discloses a container strip having inserted elements or material which have an effect on contents which may be disposed in a container and/or enhance the package. In one embodiment the insert has anti-corrosion properties. After corrosion -susceptible products have been sealed within the container, chemicals in the insert create a protective environment for the products. By providing inserts with other appropriate chemical constituents, other desirable effects can be created. In an alternative embodiment, an insert can be used in a header portion of the container to provide support for display purposes.

U.S. Pat. No. 4,382,507 discloses an absorbent pad which is useful in a receptacle for containing and displaying food products which tend to exude juices or liquids. The absorbent pad includes a mat of liquid absorbent material, which includes a layer of paper wadding and a layer of wood fluff, with the layers being mechanically interconnected. A plastic liquid impermeable sheet overlies one side of the mat, and a plastic perforated sheet overlies the other side. When the food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life. The pad also has independent utility as a moisturizing device for use in closed food containers or packages.

U.S. Pat. No. 4,321,997 discloses a receptacle for moisture-exuding food products which tend to exude Juices or liquids, and which includes a supporting member, such as a tray or bag, and an absorbent pad associated therewith. The absorbent pad includes a mat of liquid absorbent material, an upper liquid impermeable plastic sheet overlying the absorbent mat. At least one of the sheets is perforated, and a spacer is disposed between the two sheets to maintain their separation under a compressive load, and such that the ability of the pad to absorb liquids is unimpaired when the pad is subjected to a compressive load resulting from the food product resting thereon or the like. Preferably only the bottom sheet is perforated, and when a food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life.

U.S. Pat. No. 4,275,811 discloses a receptacle for containing and displaying food products which tend to exude juices or liquids, and which includes a supporting member, such as a tray or bag, and an absorbent pad associated therewith. The absorbent pad includes a mat of liquid absorbent material, an upper liquid impermeable sheet overlying the absorbent mat, and a perforated bottom sheet underlying the absorbent mat. When a food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life. The pad also has independent utility as a moisturizing device for use in closed food containers or packages.

U.S. Pat. No. 3,156,402 discloses a liquid absorbing and concealing device for containing juice exuding product such as meat or poultry, including a tray formed from substantially moisture resistant and opaque material and having a flat bottom surface; a flat sheet of thin substantially moisture resistant and opaque material placed in the tray to rest on the flat bottom surface thereof with a liquid absorbing capillary gap existing between the sheet and the flat bottom surface, the sheet having a plurality of small juice absorbing openings therethrough spaced substantially over the entire area thereof.

U.S. Pat. No. 2,537,196 discloses a humidor tobacco pouch including a double sheet of pliable, waterproof material, all edges of which are attached to each other, the lower portion of the double sheet being folded upon itself and the edges thereof being attached to the edges of the unfolded portion of the sheet, thus forming a pocket for a substance to be maintained at a predetermined humidity, the inner sheet of the rear wall of the pocket having perforations therethrough and the outer sheet of the front wall having a transverse slit therethrough, thereby forming a single thickness walled pocket positioned forwardly to the first mentioned pocket for a moisture-containing element, and the rear wall of the forwardly to the first mentioned pocket for a moisture-containing element, and the rear wall of the forwardly positioned pocket having perforations therethrough, the perforations in both instances being adapted for transferring moisture from the element to the substance whereby the substance is substantially evenly humidified.

SUMMARY OF THE INVENTION

In accordance with the present invention there is provided a food storage bag with soaker pad. The bag of the invention includes a bag having a front and rear panel of a plastic film, the front and rear panels being closed at one end to form a bottom of the bag, the bag being open at the opposite end for receipt of food to be stored in the bag, a fluid absorbing pad located inside the bag, and an enclosure connected to the inside of the bag for containing the fluid absorbing pad.

BRIEF DESCRIPTION OF THE PREFERRED EMBODIMENTS

Figure 1:
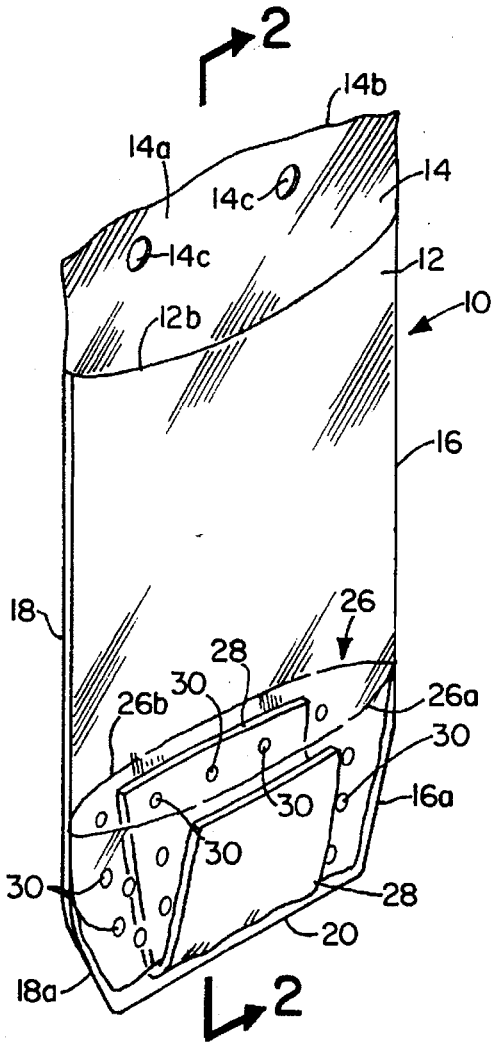
FIG. 1 is a perspective view of a first embodiment of the bag of the present invention.
Figure 2:
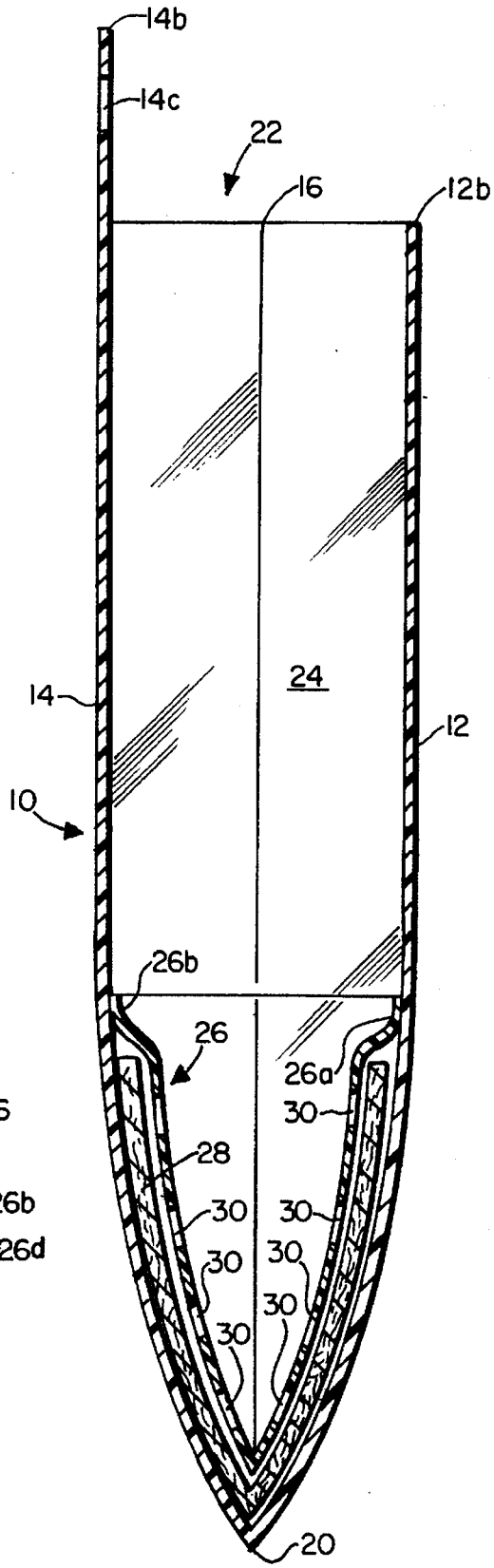
FIG. 2 is a cross sectional view taken along lines 2—2 of FIG. 1.

Referring now to the drawings, in FIGS. 1 and 2 is shown a first embodiment of the storage bag of the invention generally indicated by the numeral 10. Bag 10 has a front panel 12 and a rear panel 14 which are preferably made from a single, integral piece of plastic film. Front panel 12 is joined to rear panel 14 by side seams 16 and 18 and by bottom fold 20. Side seams 16 and 18 have lower tapered portions 16*a* and 18*a*, respectively. However, the lower tapered portions 16*a* and 18*a* could be deleted and seams 16 and 18 could intersect bottom 20 perpendicularly if desired. Furthermore, rather than being formed in a straight line, the lower tapered portions 16*a* and 18*a* could be shaped like an arc or a portion of an ellipse.

Front panel 12 has a top edge 12*b* which is not connected to rear panel 14, and rear panel 14 has a top edge 14*b* which is not connected to front panel 12. Top edge 14*b* is located at a distance above top edge 12*b* to form lip 14*a*. Rear panel may have wicket holes 14*c* adjacent the top edge 14*b* if desired for stacking the bags as is known in the art. If desired, top edge 12*b* and top edge 14*b* could lie immediately adjacent to each other, and lip 14*a* and wicket holes 14*c* could be eliminated.

Thus, an opening 22 shown in FIG. 2 is formed in the top end of bag 10. Goods such as poultry, beef, vegetables, or any other fluid exuding item may be inserted into the inside 24 of bag 10 through opening 22. Preferably, bag 10 is used to contain and store poultry. The poultry may be whole such as a cleaned and dressed chicken, or the poultry may be cut into pieces such as chicken quarters, or thighs, drumsticks, or wings.

Located inside bag 10 is an enclosure made from plastic film generally indicated by the numeral 26 for loosely containing the fluid absorbing pad 28 and liquids emanating from goods stored in bag 10. Although it is preferred that fluid absorbing pad 28 may be loosely contained or held in enclosure 26 and therefore be free to move therein, pad 28 could be connected to enclosure 26 to prevent movement therein if desired.

Figure 3:
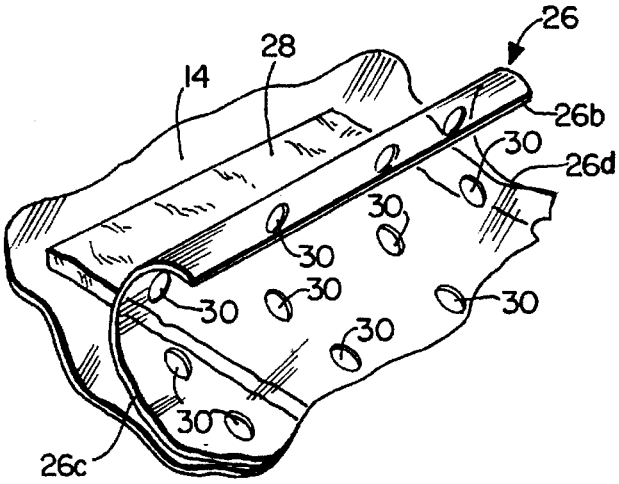
FIG. 3 is a perspective view of a portion of the bottom of the bag shown in FIG. 1 during construction thereof.

Enclosure 26 is connected at seam 26*a* to front panel 12 and at seam 26*b* to rear panel 14. Preferably, enclosure 26 is connected along its sides 26*c* and 26*d* shown in FIG. 3 to side seams 16 and 18 of bag 10 and to tapered portions 16*a* and 18*a*. However, if desired, enclosure 26 could be narrower than the width of bag 10.

In FIG. 1 and 2, seams 26*a* and 26*b* are shown connected to front panel 12 and rear panel 14, respectively, at approximately the same distance from the bottom fold 20 of bag 10. If desired, seam 26*b* could be located a greater distance from the bottom fold 20 than seam 26*a* to coincide with the borders of printed matter that may appear on the front panel 12 of bag 10. Furthermore, if desired, seam 26*a* or 26*b* could be located adjacent to bottom fold 20.

Fluid absorbing pad 28 is also referred to in the art, and sometimes herein, as a "soaker pad". Soaker pads are well known in the art and may be made from a variety of fluid absorbing materials. Soaker pad 28 may be made from manufactured or synthetic fibers, or natural fibers, or a combination thereof, either woven or non-woven, which are secured or attached to each other. Preferably, the absorbent material fibers of the fluid absorbing pad or soaker pad 28 are formed from cellulosic materials such as paper or the like.

It is not necessary that the soaker pad 28 be covered with plastic film as disclosed in U.S. Pat. No. 5,055,332 and the like, because the soaker pad utilized in the present invention is contained in plastic film enclosure 26 and will not come in direct contact with the goods contained in bag 10. Thus, inexpensive soaker pads 28 made from absorbent materials having no plastic film cover attached thereto may be used in the bag 10 of the present invention.

Enclosure 26 has a plurality of perforations 20 which are substantially uniform over its full area. The perforations 30 permit liquids to travel therethrough from the goods contained in bag 10 to the soaker pad 28. Soaker pad 28 absorbs and retains the liquids from the goods. Furthermore, some of the liquids which may not be absorbed or retained by soaker pad 28 are retained within the enclosure 26 which functions as a fluid sump or reservoir.

Figure 4:
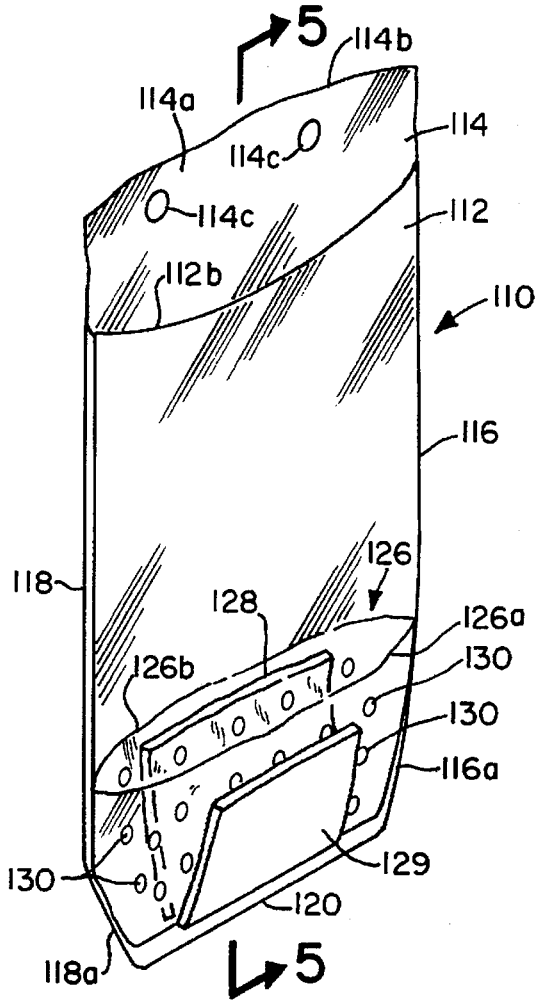
FIG. 4 is a perspective view of a second embodiment of the bag of the present invention.
Figure 5:
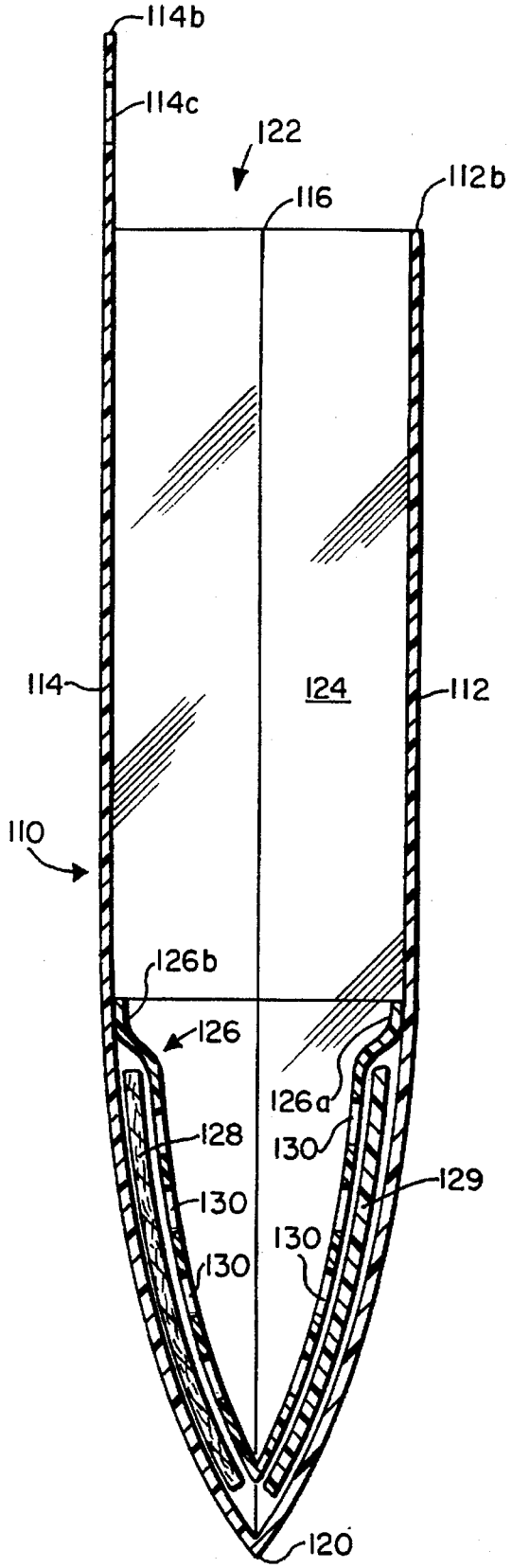
FIG. 5 is a cross sectional view taken along lines 5—5 of FIG. 4.

Referring now to FIGS. 4 and 5, there is shown a second embodiment of the storage bag of the invention generally indicated by the numeral 110. Bag 110 has a front panel 112 and a rear panel 114 which are preferably made from a single, integral piece of plastic film. Front panel 112 is joined to rear panel 114 by side seams 116 and 118 and by bottom fold 120. Side seams 116 and 118 have lower tapered portions 116*a* and 118*a*, respectively. However, the lower tapered portions 116*a* and 118*a* could be deleted and seams 116 and 118 could intersect bottom 120 perpendicularly if desired. Furthermore, rather than being formed in a straight line, the lower tapered portions 116*a* and 118*a* could be shaped like an arc or a portion of an ellipse.

Front panel 112 has a top edge 112*b* which is not connected to rear panel 114, and rear panel 114 has a top edge 114*b* which is not connected to front panel 112. Top edge 114*b* is located at a distance above top edge 112*b* to form lip 114*a*. Rear panel may have wicket holes 114*c* adjacent the top edge 114*b* if desired for stacking the bags as is known in the art. If desired, top edge 112*b* and top edge 114*b* could lie immediately adjacent to each other, and lip 114*a* and wicket holes 114*c* could be eliminated.

Thus, an opening 122 shown in FIG. 5 is formed in the top end of bag 110. Goods such as poultry, beef, vegetables, or any other fluid exuding item may be inserted into the inside 124 of bag 110 through opening 122. Preferably, bag 110 is used to contain and store poultry. The poultry may be whole such as a cleaned and dressed chicken, or the poultry may be cut into pieces such as chicken quarters, or thighs, drumsticks, or wings.

Located inside bag 110 is an enclosure made from plastic film generally indicated by the numeral 126 for loosely containing the fluid absorbing pad 128, non-absorbent spacer pad 129, and liquids emanating from goods stored in bag 110. Non-absorbent spacer pad 129 maintains a space or distance between front panel 112 and enclosure 126 so that liquids may collect between front panel 112 and enclosure 126 and travel to pad 128. Although it is preferred that fluid absorbing pad 128 and non-absorbent spacer pad 129 may be loosely contained or held in enclosure 126 and therefore be free to move therein, pads 128 and 129 could be connected to enclosure 126 to prevent movement therein if desired.

Enclosure 126 is connected at seam 126*a* to front panel 112 and at seam 126*b* to rear panel 114. Preferably, enclosure 126 is connected along its sides in the same manner as enclosure 26, shown in FIGS. 1, 2, and 3, to side seams 116 and 118 of bag 110 and to tapered portions 116*a* and 118*a*. However, if desired, enclosure 126 could be narrower than the width of bag 110.

In FIG. 4 and 5, seams 126*a* and 126*b* are shown connected to front panel 112 and rear panel 114, respectively, at approximately the same distance from the bottom fold 120 of bag 110. If desired, seam 126*b* could be located a greater distance from the bottom fold 120 than seam 126*a* to coincide with the borders of printed matter that may appear on the front panel 112 of bag 110. Furthermore, if desired, seam 126*a* or 126*b* could be located adjacent to bottom fold 120.

Fluid absorbing pad 128 is also referred to in the art, and sometimes herein, as a "soaker pad". Soaker pad 128 may be constructed from the same materials and in the same manner as soaker pad 28 in FIGS. 1–3.

Enclosure 126 has a plurality of perforations 130 which are substantially uniform over its full area. The perforations 130 permit liquids to travel therethrough from the goods contained in bag 110 to the soaker pad 128. Soaker pad 128 absorbs and retains the liquids from the goods. Furthermore, some of the liquids which may not be absorbed or retained by soaker pad 128 are retained within the enclosure 126 which functions as a fluid sump or reservoir.

Figure 6:
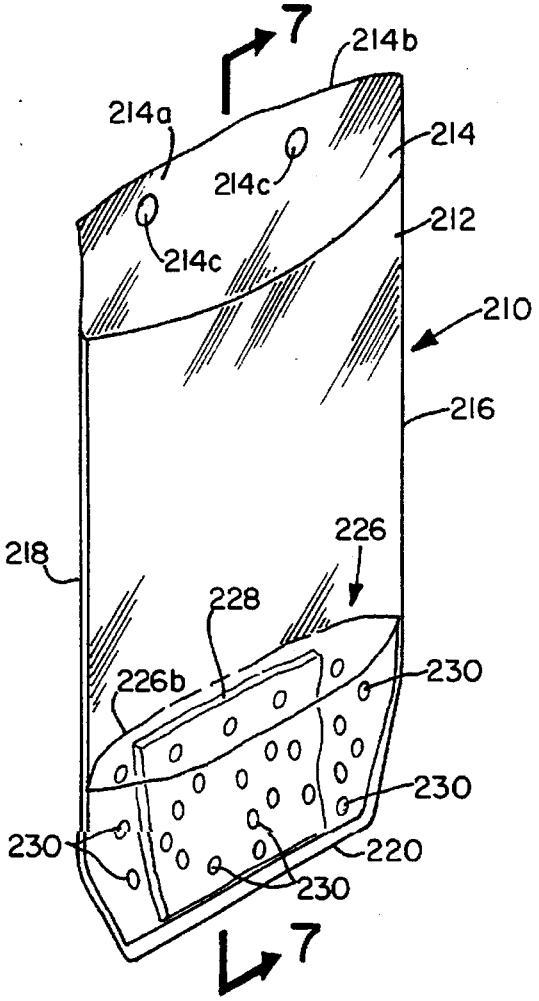
FIG. 6 is a perspective view of a third embodiment of the bag of the present invention.
Figure 7:
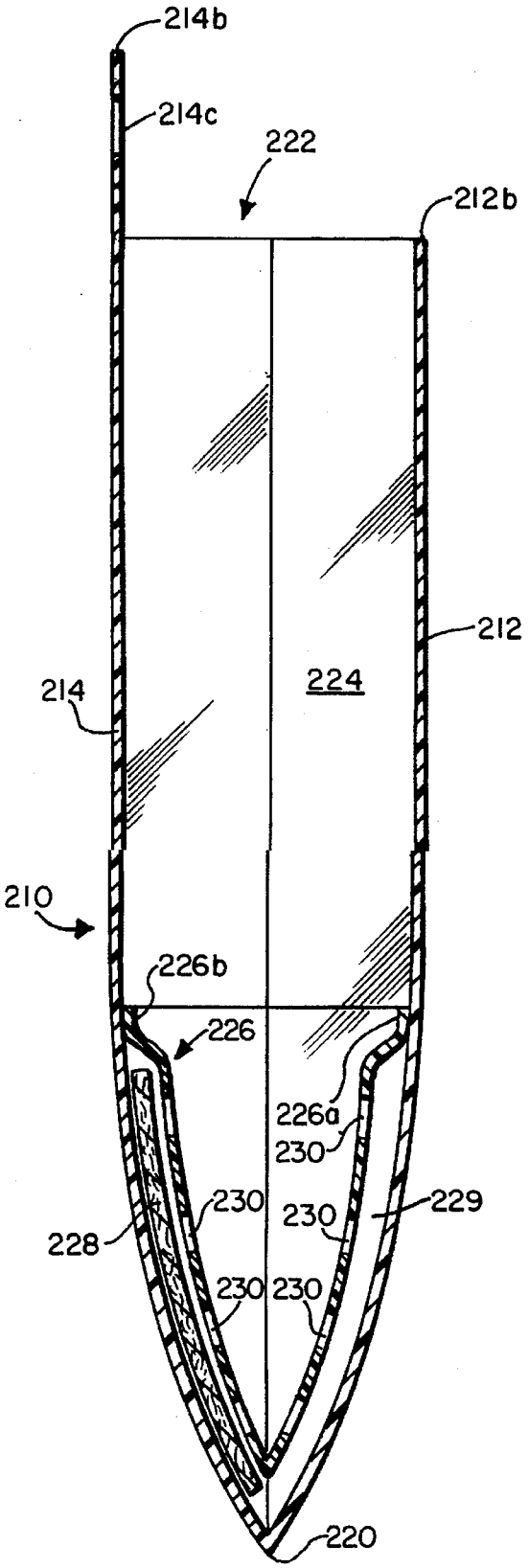
FIG. 7 is a cross sectional view taken along lines 7—7 of FIG. 6.

Referring now to FIGS. 6 and 7, there is shown a third embodiment of the storage bag of the invention generally indicated by the numeral 210. Bag 210 has a front panel 212 and a rear panel 214 which are preferably made from a single, integral piece of plastic film. Front panel 212 is joined to rear panel 214 by side seams 216 and 218 and by bottom fold 220. Side seams 216 and 218 have lower tapered portions **216*a* and 218*a*, respectively. However, the lower tapered portions 216*a* and 218*a* could be deleted and seams 216 and 218 could intersect bottom 220 perpendicularly if desired. Furthermore, rather than being formed in a straight line, the lower tapered portions 216*a* and 218*a*** could be shaped like an arc or a portion of an ellipse.

Front panel 212 has a top edge **212*b* which is not connected to rear panel 214, and rear panel 214 has a top edge 214*b* which is not connected to front panel 212. Top edge 214*b* is located at a distance above top edge 212*b* to form lip 214*a*. Rear panel may have wicket holes 214*c* adjacent the top edge 214*b* if desired for stacking the bags as is known in the art. If desired, top edge 212*b* and top edge 214*b* could lie immediately adjacent to each other, and lip 214*a* and wicket holes 214*c*** could be eliminated.

Thus, an opening 222 shown in FIG. 7 is formed in the top end of bag 210. Goods such as poultry, beef, vegetables, or any other fluid exuding item may be inserted into the inside 224 of bag 210 through opening 222. Preferably, bag 210 is used to contain and store poultry. The poultry may be whole such as a cleaned and dressed chicken, or the poultry may be cut into pieces such as chicken quarters, or thighs, drumsticks, or wings.

Located inside bag 210 is an enclosure made from plastic film generally indicated by the numeral 226 for loosely containing the fluid absorbing pad 228, and liquids emanating from goods stored in bag 210. Fluid absorbing pad 228 is placed between the rear panel 214 and the enclosure 226. A space or reservoir 229 exists between front panel 212 and enclosure 226 so that liquids may collect between front panel 212 and enclosure 226 in space 229. Although it is preferred that fluid absorbing pad 228 may be loosely contained or held in enclosure 226 and therefore be free to move therein, pads 228 and 229 could be connected to enclosure 226 to prevent movement therein if desired.

Enclosure 226 is connected at seam **226*a* to front panel 212 and at seam 226*b* to rear panel 214. Preferably, enclosure 226 is connected along its sides in the same manner as enclosure 26, shown in FIGS. 1, 2, and 3, to side seams 216 and 218 of bag 210 and to tapered portions 216*a* and 218*a*. However, if desired, enclosure 226 could be narrower than the width of bag 210**.

In FIG. 6 and 7, seams **226*a* and 226*b* are shown connected to front panel 212 and rear panel 214, respectively, at approximately the same distance from the bottom fold 220 of bag 210. If desired, seam 226*b* could be located a greater distance from the bottom fold 220 than seam 226*a* to coincide with the borders of printed matter that may appear on the front panel 212 of bag 210. Furthermore, if desired, seam 226*a* or 226*b* could be located adjacent to bottom fold 220**.

Fluid absorbing pad 228 is also referred to in the art, and sometimes herein, as a "soaker pad". Soaker pad 228 may be constructed from the same materials and in the same manner as soaker pad 28 in FIGS. 1–3.

Enclosure 226 has a plurality of perforations 230 which are substantially uniform over its full area. The perforations 230 permit liquids to travel therethrough from the goods contained in bag 210 to the soaker pad 228. Soaker pad 228 absorbs and retains the liquids from the goods. Furthermore, some of the liquids which may not be absorbed or retained by soaker pad 228 are retained within the enclosure 226 and reservoir 229 which functions as a fluid sump or reservoir.

The bags of the invention are constructed from plastic film well known in the art. Preferably, the bags of the invention are constructed from flexible thermoplastic film such as polyvinylidene chloride, polyethylene, polypropylene, and the like. A particularly preferred thermoplastic film is polyethylene.

The bags of the invention may be constructed by any method or methods known in the art. A preferred method of attaching enclosure 26 is by heat sealing. Furthermore, the bags of the invention may be made in any desired shape. Preferably the bags 10, 110 and 210 are generally rectangular in shape, as are the enclosures 26, 126 and 226, and the soaker pads 28, 128 and 228.

Although the preferred embodiments of the invention have been described in detail above, it should be understood that the invention is in no sense limited thereby, and its scope is to be determined by that of the following claims:

What is claimed is:

1. A storage bag with soaker pad, said storage bag comprising:

a. a bag having a front and rear panel constructed from plastic film, said front and rear panels being closed along a fold at one end to form a bottom of said bag, said bag being open at the opposite end for receipt of goods to be stored in said bag;

b. enclosure means for containing and confining liquids emanating from goods stored inside said bag, said enclosure means comprising a single piece of film that is less than half the length of the combined length of said front panel and said rear panel of said bag, said enclosure means being folded to form a bottom fold and two walls, said enclosure means being connected by continuous seams at all of its edges to the inside surface of both of said front and rear panels of said bag, said enclosure means being connected to said bag such that said bottom fold of said enclosure means is unconnected to but adjacent to said bottom fold of said bag, said walls of said enclosure means are contiguous with the bottom portion of both of said front and rear panels, and said continuous seams are the only connection between said enclosure means and said bag such that there is space between said walls of said enclosure means and the inside surface of said bottom portion of both of said front and rear panels, said enclosure means having a plurality of spaced apart perforations therein for conveying said liquids through said enclosure means to said space between said walls of said enclosure means and the interior surface of said bottom portion of said front and rear panels to which said enclosure means is connected, c. pad means for absorbing said fluids that are located in said space between said walls of said enclosure means and the interior of said bottom portion of said front and rear panels to which said enclosure means is connected, said pad means being located in said space between said walls of said enclosure means and the interiors of said bottom portion of said front and rear panels to which said enclosure means is connected, said pad means being smaller in volume than said space between said walls of said enclosure means and the interior surface of said bottom portion of said front and rear panels to which said enclosure means is connected, said enclosure means totally enclosing said pad means to define a first reservoir and a second reservoir for containing and confining said liquids, i. said first reservoir comprising said pad means, and ii. said second reservoir comprising a sump, said sump being the portion of said space between said walls of said enclosure means and the interior surface of said bottom portion of said front and rear panels to which said enclosure means is connected that is not occupied by said pad means.

2. The storage bag of claim 1 wherein said pad means is connected to said enclosure means.

3. The storage bag of claim 1 wherein said pad means is substantially smaller in volume than said space between said walls of said enclosure means and the interior surface of said bottom portion of said front and rear panels to which said enclosure means is connected.

4. The storage bag of claim 3 wherein said pad means is less than one-half of the volume of said space between said enclosure means and the interior of said bottom portion of said front and rear panels to which said enclosure means is connected.

5. The storage bag of claim 3 wherein said pad means is connected to said enclosure means.

6. The storage bag of claim 1 wherein said goods are food products.

7. The storage bag of claim 6 wherein said food products are chicken.

8. The storage bag of claim 1 wherein food products are located in said bag.

9. The storage bag of claim 8 wherein said food products are chicken.

10. The storage bag of claim 1 wherein said plastic film is transparent.

11. The storage bag of claim 1 wherein said pad means consists of natural fibers which are secured together.

12. The storage bag of claim 11 wherein said fibers are cellulosic materials.

13. The storage bag of claim 1 wherein said pad means consists of synthetic fibers which are secured together.

14. The storage bag of claim 1 wherein said pad means comprises fibers which are a combination of synthetic and cellulosic materials which are secured together.

15. The storage bag of claim 1 wherein said pad means is made from fibers secured together and has no plastic film cover connected thereto.

16. The storage bag of claim 1 wherein said enclosure means is generally rectangular in shape.

17. The storage bag of claim 1 wherein said pad means is generally rectangular in shape.

18. The storage bag of claim 1 wherein said pad means is located in the space between both said front panel and said rear panel and said respective walls of said enclosure means.

19. The storage bag of claim 1 wherein said pad means is located in the space between said rear panel and said respective wall of said enclosure means.

* * * * *